US006631580B2

(12) United States Patent
Iafrate et al.

(10) Patent No.: US 6,631,580 B2
(45) Date of Patent: Oct. 14, 2003

(54) FIREARM BORE SIGHT SYSTEM

(75) Inventors: Terry A. Iafrate, Weatherford, OK (US); Kelly J. Davis, Mead, WA (US)

(73) Assignee: Hunts, Inc., Mead, WA (US)

( * ) Notice: Subject to any disclaimer, the term of this patent is extended or adjusted under 35 U.S.C. 154(b) by 0 days.

(21) Appl. No.: 09/805,736

(22) Filed: Mar. 13, 2001

(65) Prior Publication Data

US 2002/0129536 A1 Sep. 19, 2002

(51) Int. Cl.[7] ..... F41G 1/00
(52) U.S. Cl. ..... 42/134
(58) Field of Search ..... 42/111, 116, 114, 42/134, 132

(56) References Cited

U.S. PATENT DOCUMENTS

| | | | | |
|---|---|---|---|---|
| 1,645,881 A | * | 10/1927 | Strong | 362/111 |
| 3,471,945 A | * | 10/1969 | Fleury | 362/110 |
| 3,782,832 A | | 1/1974 | Hacskaylo | |
| 4,481,561 A | * | 11/1984 | Lanning | 362/111 |
| 4,530,162 A | | 7/1985 | Forrest et al. | |
| 4,825,258 A | | 4/1989 | Whitson | |
| 4,830,617 A | * | 5/1989 | Hancox et al. | 362/111 |
| 4,879,814 A | * | 11/1989 | Wallace et al. | 33/DIG. 21 |
| 5,001,836 A | | 3/1991 | Cameron et al. | |
| 5,241,458 A | * | 8/1993 | Abbas | 356/241.2 |
| 5,351,429 A | | 10/1994 | Ford | |
| 5,365,669 A | * | 11/1994 | Rustick et al. | 33/DIG. 21 |
| 5,432,598 A | | 7/1995 | Szatkowski | |
| 5,446,535 A | | 8/1995 | Williams | |
| 5,454,168 A | * | 10/1995 | Langner | 356/153 |
| 5,488,795 A | * | 2/1996 | Sweat | 362/112 |
| 5,531,040 A | | 7/1996 | Moore | |
| 5,685,106 A | * | 11/1997 | Shoham | 42/116 |
| 5,787,631 A | * | 8/1998 | Kendall | 42/116 |
| 5,909,951 A | * | 6/1999 | Johnsen et al. | 362/111 |
| 6,061,918 A | | 5/2000 | Schnell | |
| 6,151,788 A | * | 11/2000 | Cox et al. | 33/286 |
| 6,216,381 B1 | * | 4/2001 | Strand | 42/113 |

FOREIGN PATENT DOCUMENTS

| | | |
|---|---|---|
| CA | 2187159 | 8/1996 |
| CA | 2217791 | 6/1999 |
| CA | 2308688 | 11/2000 |
| EP | 0 773 422 A1 | 5/1997 |

* cited by examiner

*Primary Examiner*—Charles T. Jordan
*Assistant Examiner*—Jordan M Lofdahl
(74) *Attorney, Agent, or Firm*—Wells St. John P.S.

(57) ABSTRACT

A firearm bore sighting system is described in which conventionally shaped cartridge body with a rim at a base end and an open forward end includes a bore formed along a cartridge axis. An optical beam emitting device is received within the bore, with potting material formed about the beam emitting device, securing the beam emitting device in a spatial relation to the cartridge axis such that an optical beam emitted from the beam emitting device is coaxial with the cartridge axis.

5 Claims, 5 Drawing Sheets

FIREARM BORE SIGHT SYSTEM

TECHNICAL FIELD

The present invention relates to bore sighting for firearms, and particularly to a device that aids in bore sighting procedures.

BACKGROUND OF THE INVENTION

The prior processes involved for "sighting in" a firearm typically involve the use of a target and live ammunition. While this process is typically satisfactory for the shooter, a considerable amount of time and a degree of expense are involved.

The above "sighting in" process may not be available in certain situations. For example, a hunter may jar the firearm and upset the previous sight adjustments. The hunter may be in a situation where the typical process for "sighting in" the weapon is not possible or advisable. This is especially true in situations where the discharge of the firearm could have a negative effect on hunting situations. Further, access to a proper target range is not always easily available. A need has therefore been realized for some form of sighting device that does not require discharge of live ammunition to at least initially accurately set the targeting sights of the firearm.

In response to the above need, various forms of "bore" sighting devices have been developed. In the distant past, such sighting devices made use of incandescent-type lights. More recent developments, however, have lead to the use of laser sighting arrangements. Of these, numerous units are adapted for insertion at the muzzle end of the firearm. The use of a laser certainly increases the potential for accuracy. However, the mounting of a laser in the muzzle end of a firearm does not necessarily lead to an accurate representation of the path a bullet will travel to a selected spot on a target. A very slight misalignment of the laser beam from this point will result in huge magnification of the error at even relatively short distances.

Others have sought the solution of mounting a laser optical device within the firing chamber of a firearm. One such device is described in U.S. Pat. No. 5,787,631 to Kendall. This patent, while describing a substantial improvement over prior forms of optical bore sighting devices, included accuracy problems. The lens for the laser was provided separately from the laser module and could be subject to misalignment. The laser module itself, was adjustable by means of four set screws that were provided equally spaced about a transverse plane. These securing devices could be easily adjusted by the user with the end result being that the light beam could be easily adjusted to an angle different from the long axis of the insert. The insert was designed to simulate a particular firearm cartridge and, if accurately machined, would, upon loading in the firearm breach, would automatically become centered with the cartridge body axis coaxial with the axis of the firearm bore. A misadjustment of the set screws or even a temperature change or jolt could affect the mounting arrangement and cause misalignment of the laser beam, thereby negatively affecting the sighting performance of the device.

A need has remained for a firearm bore sight system that will maintain an accurate coaxial relationship with a firearm cartridge-shaped insert so that a light beam will be maintained in a coaxial relationship with a firearm bore so a reliable and repeatable identification can be easily and quickly determined for a bullet impact point. A dot of light, then, at a distance of, say, thirty yards, will reliably indicate that point as being along the axis of the firearm bore. This point can then be used to accurately gage and calibrate the external sighting device for the weapon.

A difficulty stemming from use of an adjustable bore sight of the type inserted within the firing chamber of a firearm, is that the beam generated by the optics must not impinge on the sidewalls of the firearm bore. If this happens, the beam becomes diffused and will not produce an accurate indication of the bore axis. Further, it is very difficult to withdraw the sighting unit and make adjustments that are meaningful. The typical casing is substantially cylindrical and can be rotated, either intentionally or unintentionally and this factor seriously affects any potential adjustments that might be made. A solution to this issue is to pre-calibrate the sighting device at the factory where the device is made. However, the adjustment screws allow for tampering and a slight misalignment of the device could lead to an attempt by the owner or operator to readjust the unit, thereby seriously misaligning the device and frustrating the intent to provide an accurate sighting device.

An object of the present invention is to provide a firearm bore sighting system which may be readily calibrated initially and then substantially permanently set in the calibrated condition for continued accurate usage.

Another objective is to provide such a device that includes adjustment and calibration features that operate on a complete module including lens so the beam produced by the beam-emitting device is consistent regardless of the adjusted position of the unit.

A still further objective is to provide such a device that may be utilized in different caliber firearms.

A yet further objective is to provide such a system that is stable and capable of withstanding normal wear and tear.

A yet further objective is to provide such a device that includes ready access to internal batteries.

These and still further objectives and advantages will become apparent upon reading the following description.

BRIEF DESCRIPTION OF THE DRAWINGS

Preferred embodiments of the invention are described below with reference to the following accompanying drawings.

FIG. 5 is a sectional view showing an exemplary device within the bore of a firearm.

DESCRIPTION OF THE PREFERRED EMBODIMENTS

Figure 1:
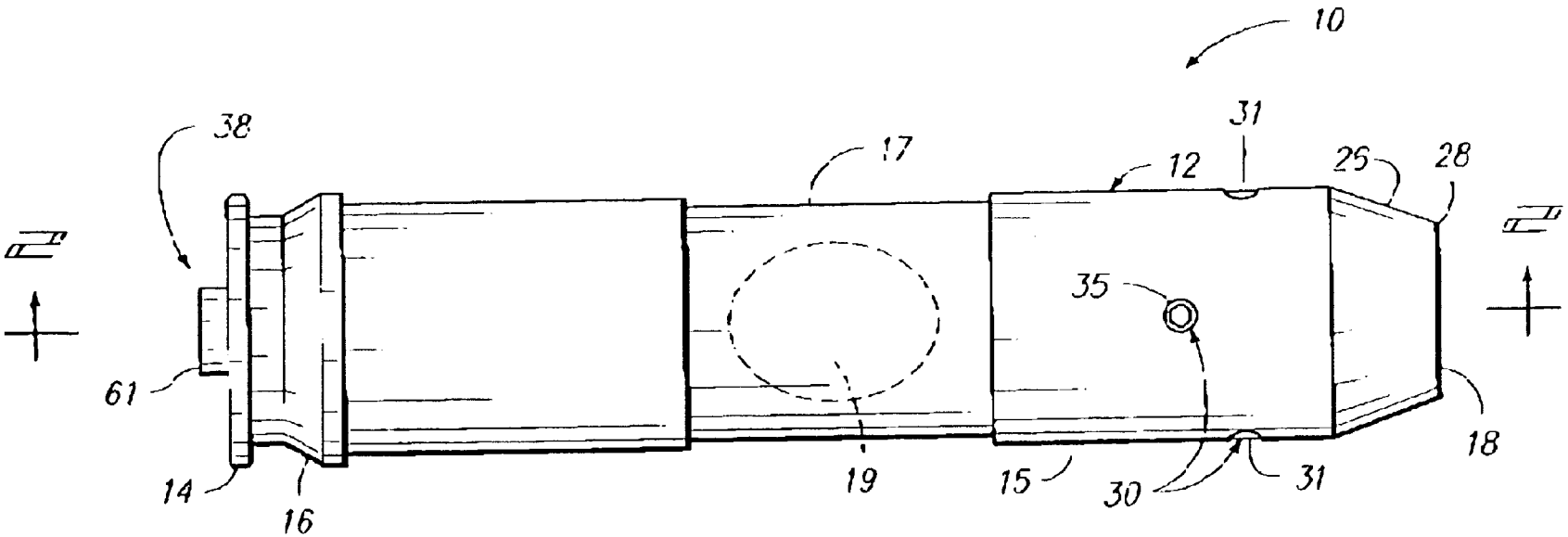
FIG. 1 is a side elevation view of an exemplary firearm bore sighting device.
Figure 2:
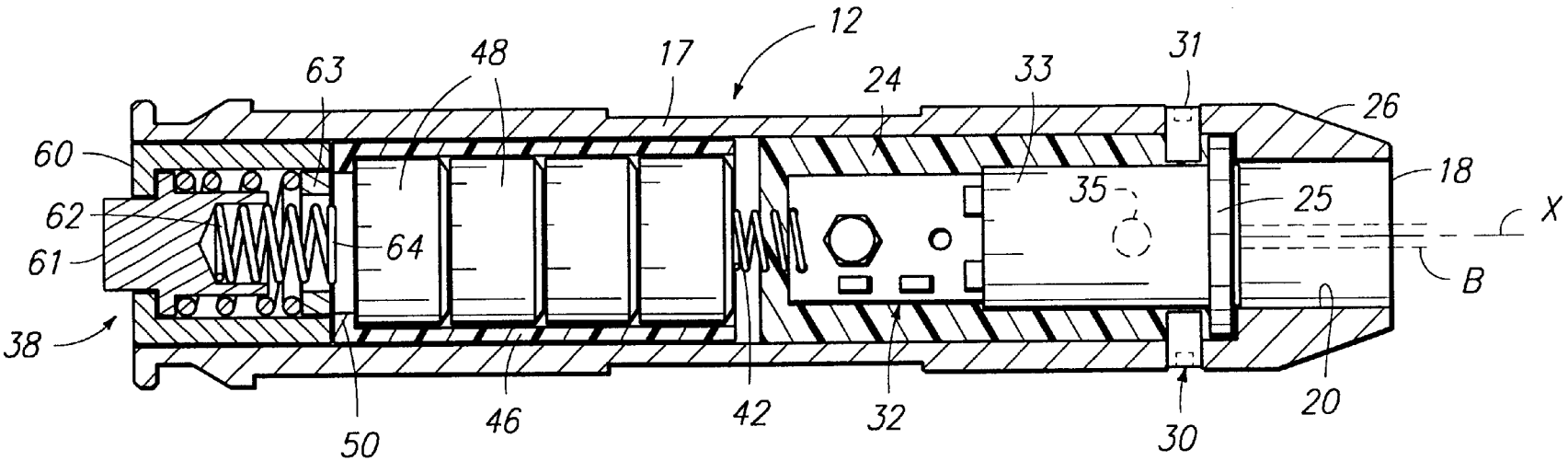
FIG. 2 is an enlarged sectional view taken substantially along line 2—2 in FIG. 1.

This disclosure of the invention is submitted in furtherance of the constitutional purposes of the U.S. Patent Laws "to promote the progress of science and useful arts" (Article 1, Section 8).

It should be noted that certain of the fasteners, materials, power sources, mechanisms, control circuitry, manufacturing and other means and components utilized to make and implement this invention are known and used in the field of the invention described, and their exact nature or type is not necessary for an understanding and use of the invention by a person skilled in the art or science. As such, specific details of such means and components will not be discussed in great detail herein.

Furthermore, the various components shown or described herein for any specific application of this invention can be varied or altered as anticipated by this invention and the practice of a specific application or embodiment of any element may already be widely known or used in the art or by persons skilled in the art or science.

The terms "a", "an", and "the" as used in the claims and elsewhere herein are used in conformance with long-standing claim drafting practice and not in a limiting way. Unless specifically set forth herein, the terms "a", "an", and "the" are not limited to one of such elements, but instead mean "at least one".

GENERAL DESCRIPTION

Before specific details are provided, describing preferred exemplary features of the invention, general aspects will be given.

In one preferred aspect, a firearm bore sighting system 10 includes a cartridge body 12 formed in the shape of a conventional firearm cartridge, and including a rim 14 at a base end 16 and an open forward end 18. A bore 20 is formed within the cartridge body along a cartridge axis X. An optical beam emitting device 22 is received within the bore 20, and potting material 24 us formed about the beam emitting device 22 within the bore 20. The beam emitting device 22 is thus secured in a spatial relation to the cartridge axis X such that an optical beam B emitted from the beam emitting device 22 is coaxial with the cartridge axis X.

Referring to the invention in another way, a firearm bore sighting system 10 includes a cartridge body 12 formed in the shape of a conventional firearm cartridge, and including a rim 14 at a base end 16 and a shoulder 26 defining an open forward end 18. The body 12 is formed along a central longitudinal cartridge axis X and the shoulder 26 is formed as a frustum of a cone, centered on the cartridge axis X with the open forward end 18 at a reduced end 28 of the frustum. A bore 20 is formed within the cartridge body 12 along the cartridge axis X. An optical beam emitting device 22 is received within the bore and operable to generate an optical beam B coaxially with the cartridge axis X.

Stated in yet another way, the present invention includes a firearm bore sighting system 10 in which a cartridge body 12 formed in the shape of a conventional firearm cartridge, and including a rim 14 at a base end 16 and an open forward end 18. A bore 20 is formed within the cartridge body 12 along a cartridge axis X. An optical beam emitting device 22 is received within the bore 20, with beam calibrating adjustments 30 mounted between the beam emitting device 22 and the cartridge body 12. The adjustments 30 are axially staggered with respect to the bore axis X and are spaced angularly about the bore axis X.

A further aspect of the invention includes a firearm bore sighting system 10 that provides a cartridge body 12 formed in the shape of a conventional firearm cartridge, and including a rim 14 at a base end 16 and an open forward end 18. A bore 20 is formed within the cartridge body 12 along a cartridge axis X, receiving an optical beam emitting device 22 within the bore 20. Beam calibrating adjustments 30 are mounted between the beam emitting device 22 and the cartridge body 12, said adjustments 30 being axially staggered with respect to the bore axis X and spaced angularly about the bore axis X.

Stated in another way, the invention includes a firearm bore sighting system 10 in which a cartridge body 12 is formed in the shape of a conventional firearm cartridge, and including a rim 14 at a base end 16 and an open forward end 18. A shoulder 26 is provided at the forward end. A bore 20 is formed within the cartridge body along a cartridge axis X, and an optical beam emitting device 22 is received within the bore, including an optical beam generating module 32 with a beam focusing lens 34 at one end 36 of the module 32. A switch 38 and power source 40 are electrically connected to the optical beam emitting device 22, to activate the optical beam emitting device to generate an optical beam B. The one end 36 of the optical beam generating module is spaced axially toward the base end 16 within the cartridge body 12 from the shoulder 26.

Stated in yet another way, the invention includes a bore sighting system 10 that includes a cartridge body 12 formed in the shape of a conventional firearm cartridge, and including a base end 16 and an open forward end 18. A bore 20 is formed within the cartridge body along a cartridge axis X, and an optical beam emitting device 22 is received within the bore. The device 22 includes an optical beam generating module 32 having a battery contact 42. A switch 38 is mounted to the cartridge body with an electrical contact 64 thereon that is movable between an on and an off position. A battery holder 46 is slidably received within the bore and is configured to receive and orient at least one battery 48 within the bore between the electrical contact 64 of the switch 38 and the battery contact 42. The battery holder 46 includes an integral electrically insulating flange 50 that is oriented to electrically isolate the battery 48 and electrical contact 64 in the off position, and to permit contact between the electrical contact 64 and the battery 48 with the electrical contact 64 in the on position.

In still further aspect of the invention, a bore sighting system 10 comprises a cartridge body 12 formed in the shape of a conventional firearm cartridge, and including a base end 16 and a shoulder 26 at least adjacent to an open forward end 18. A bore 20 is formed within the cartridge body along a cartridge axis X. The body 12 is formed along the cartridge axis X and the shoulder 26 is formed as a frustum of a cone, centered on the cartridge axis X with the open forward end 18 at a reduced end of the frustum. An optical beam emitting device 22 is received within the bore, including an optical beam generating module 32 having a battery contact 42. Potting material 24 is formed about the optical beam generating module 32 within the bore 20, securing the beam emitting device 22 in a spatial relation to the cartridge axis X such that an optical beam B emitted from the beam emitting device 22 is coaxial with the cartridge axis X. Beam calibrating adjustments 30 are mounted between the beam emitting device 22 and the cartridge body 12. The adjustments 30 are axially staggered with respect to the bore axis X. Further, the adjustments 30 are spaced angularly about the bore axis. A switch 38 is mounted to the cartridge body with an electrical contact 64 thereon that is movable between an on and an off position. A battery holder 46 is slidably received within the bore and is configured to receive and orient at least one battery 48 within the bore between the electrical contact 64 of the switch and the battery contact 42. The battery holder 46 includes an integral electrically insulating flange 50 that is oriented to electrically isolate the battery 48 and electrical contact 64 in the off position, and to permit contact between the electrical contact 64 and the battery 48 with the electrical contact 64 in the on position.

DETAILED DESCRIPTION

The above are generalized statements regarding various aspects of preferred forms of the invention. The following will relate to more detailed description of preferred examples of the embodiments with more specific reference to particular preferred examples elements and their relationships.

Preferred forms of the present system include the cartridge body 12 which is formed in the shape of a conventional firearm cartridge. It is preferred that the cartridge body 12 be formed of a material similar to that typically used for rifle or shotgun cartridges. Brass is a particularly suited material since numerous rifle and pistol cartridges are formed using a brass casing, and typical shotgun cartridges are also at least partially formed of brass. The body 12 is preferably machined to accurate dimensions with tolerances similar to those provided for cartridges or shell casings that are designed for specific firearms.

The cartridge body 12 extends from a rim 14 at the base end 16 to the open forward end 18. The body is formed around a central longitudinal axis X which, when the casing is chambered within a firearm (see FIG. 5), the axis X is coaxial with the bore axis of the weapon.

The term "rim" as used herein refers to the configuration at the base of the cartridge body that is made to closely resemble a corresponding similarly-shaped rim on a actual cartridge. It is understood that various forms of cartridges include different rim structures. The example illustrated is a "belted" form of rim 14 that is fairly commonly used for high power, center fire cartridges. Other forms include "rimless" cartridges which actually include a rim but without reinforced belting forward of the rim structure. Still other forms of cartridge configurations are available with different configurations at the rim area. However, all typically include some form of annular ridge or rim portion that may be selectively engaged by an extractor mechanism on the firearm, which is used to retrieve the spent casing from the firing chamber once the weapon has been discharged. The "rim" 14 therefore should be considered to be any form of rim structure that facilitates engagement by an extractor.

It is further emphasized that the exemplary rim 14 is shown as an integral part of the cartridge body 12. However, the rim could also be an integral part of the switch 38. The switch body, when attached to the cartridge body, would form the base end of the body.

The forward end 18 of the cartridge body 12 is preferably formed as a shoulder 26 that is in effect, a frustum of a cone. The reduced end of the frustum may define the open forward end 18. The frustum configuration may be provided to match the shoulder angle typically provided in a corresponding actual cartridge configuration. This shoulder may be used to position and substantially center the cartridge body 12 in the firearm firing chamber as shown in FIG. 5 of the drawings.

It is pointed out that the illustrated preferred cartridge body does not include a forward "neck" primarily because there is no requirement for the beam emitting device 22 (particularly the lens portion thereof) to be secured within a cartridge neck portion. In an actual cartridge, the neck part is that part of the cartridge that grips the projectile or bullet. By eliminating the neck portion, the present device may advantageously be utilized in numerous families of firearms that make use of similarly shaped and sized cartridge bodies even though the diameter or caliber of the bores may be different.

It is also pointed out that the rim 14 is beveled about its perimeter. The beveled edge advantageously permits extraction of the cartridge body 12 from the firearm firing chamber through use of the standard extractor provided in the associated firearm.

In preferred forms of the system 10, the cartridge body 12 includes a reduced label surface 17 that is spaced radially inward from an outward surface 15 of the cartridge body. The outward surface 15 is intended to fit in flush, sliding engagement with mating surfaces of the firing chamber of the firearm.

The reduced label surface 17 is set radially inward as may be clearly seen in FIG. 5. The surface 17 is provided to permit standard printing of information relating to the nature of the cartridge size and to permit clear identification of the necessary warning label 19 (shown by dashed lines in FIG. 1) which are typically required for laser optics. The inset label surface 17 protects the printed label from being scuffed and blurred by repeated loading and unloading of the cartridge body.

The inset surface 17 also reduces the possibility that accuracy of the light beam could be adversely affected by the thickness of any printed ink or paint materials on the cartridge body. Still further, it is advantageous that no printing or labeling be permitted to engage the complimentary surfaces of the firearm receiving chamber so as to avoid fouling the chamber with paint or ink from the label.

The preferred cartridge body 12 is provided with a central bore that is most preferably formed coaxially with the central longitudinal axis X of the cartridge body. The bore is of varied diameter to receive components which include the optical beam emitting-device 22, a battery holder 46, and the switching unit 38.

The optical beam-emitting device 22 is preferably a conventional form of laser that will emit a coherent beam of light. It is advantageous that the laser be provided as a module 32 along with the beam-producing components and a lens 34 all contained within a substantially cylindrical case 33. The lens 34 is situated at an end 36 of the module case 33 and a rearward end of the case is mounted on or connected to a circuitry arrangement of a conventional nature. In fact, the entire laser module may be provided in components arranged and known to the laser industry and will not therefore be described in detail herein. It is sufficient to indicate that the preferred module is configured to be received within the bore 20 with a battery contact 42 projecting rearwardly therefrom.

It is preferable that the battery contact 42 be in the form of a coiled compression spring. This spring is intended to yieldably engage one end of the power source 40 which may be comprised of one or more batteries 48. The batteries 48 are releasably held within a holder 46 that is slidably received within the bore 20. In a preferred form, the battery holder 46 includes an integral flange 50.

The flange 50 is advantageously formed integrally with the battery holder in order to insulate the batteries 48 from the switch 38 when the switch is in an off position and to allow access to battery contact when the switch is in the "on" position. The battery holder 46 may be easily removed from the cartridge body since it is simply slidably mounted within the bore. Batteries may be easily changed by simply removing the switch 38 and sliding the case outwardly. The batteries can then be removed and replaced and the case can be repositioned within the cartridge, followed by remounting of the switch 38.

Beam calibrating adjusters 30 are provided to initially position the beam generated by the device 22 to a coaxial relationship with the longitudinal axis X of the cartridge body 12. The adjusters may be comprised of two sets of set screws 31, 35. A forward set 31 of the set screws are positioned in diametric opposition with respect to the central axis X and are oriented substantially radially. These two screws will engage the laser module at diametrically opposed points in the area adjacent the forward case end 36.

The second set of screws 35 are situated rearwardly along the axis from the first set and are rotated about the axis approximately 90 degrees from the first set. The second set may engage the module rearwardly of the first set. Either one of the two sets of set screws can become used effectively as trunions. Thus, if the rearward set is used in this manner, the forward set can be used to angularly adjust the laser module about the trunion axis set by the rearward pair of screws. Likewise, the forward set can be used as trunions and the rearward set be used to adjust the angular position.

The above is a substantial advantage over prior adjustments that made use of four set screws set in a single plane along a central axis. Only lateral adjustment of the beam-generating arrangement could be accomplished using screws of this configuration. Furthermore, the axially offset pairs of set screws function to securely hold the laser module in position. This improves both accuracy in the adjustment and the capability of holding the accuracy by retaining the module over a substantial surface area and improving stability and shock resistance. Still further, the offset screw design minimizes movement of the module after calibration due to metal stress relief.

The beam-calibrating adjustments 30 are utilized to initially set the beam produced by the device 22 in coaxial relation with the long axis of the cartridge body. This adjustment is secured by provision of the potting material 24. The potting material is preferably a form of resin such as epoxy that may be injected or otherwise disposed within the bore 20 and cured or hardened about the device 22 to effectively secure it in position and to encase the components against movement and damage from impact. The encapsuled components are also protected against damage from moisture.

A seal 25 is provided in preferred forms adjacent the forward end of the module 32. The seal may be formed of a resinous material that will bond or combine with the potting material but that will not permit the potting material to seep or flow forwardly of the case-end 36. Thus, the resin may be injected into the bore to surround the module 32 without seeping or flowing axially further along the bore to obstruct that part of the bore between the open end 18 and the lens 34.

However, the potting material 24 may encompass the case 33 in the precalibrated set screw adjustment, along with the remainder of the module and a portion of the battery contact 42. Once hardened, the potting material 24 will securely position the contact 42 and hold the module in the calibrated position. This allows the manufacturer to remove at least three of the set screws, leaving only one for grounding contact to the cartridge body 12. The potting material extends between the beam emitting device and cartridge body to provide the advantage of damping shock or vibration while holding the device secure within the bore 20.

Figure 3:
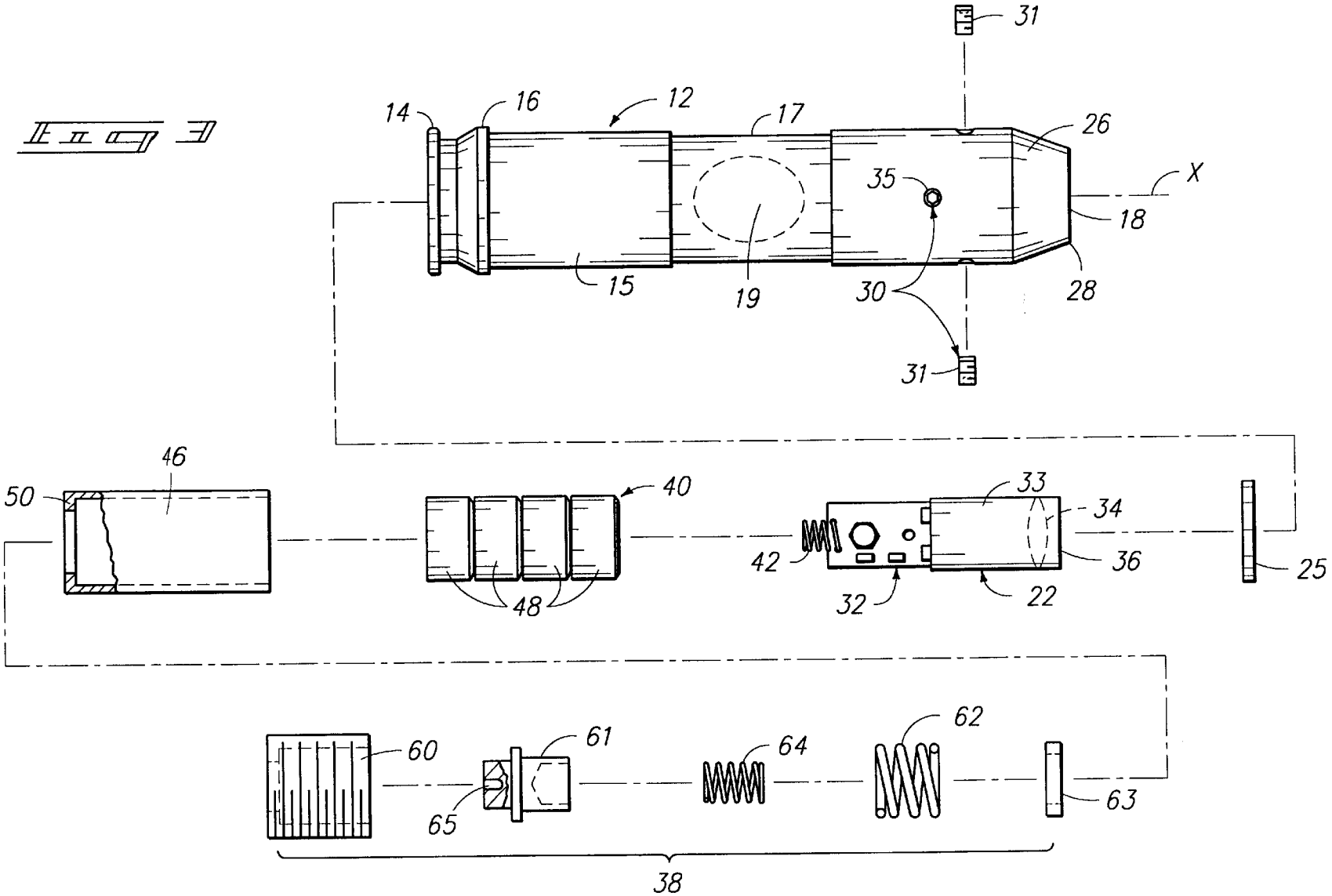
FIG. 3 is an exploded view illustrating preferred components.
Figure 4:
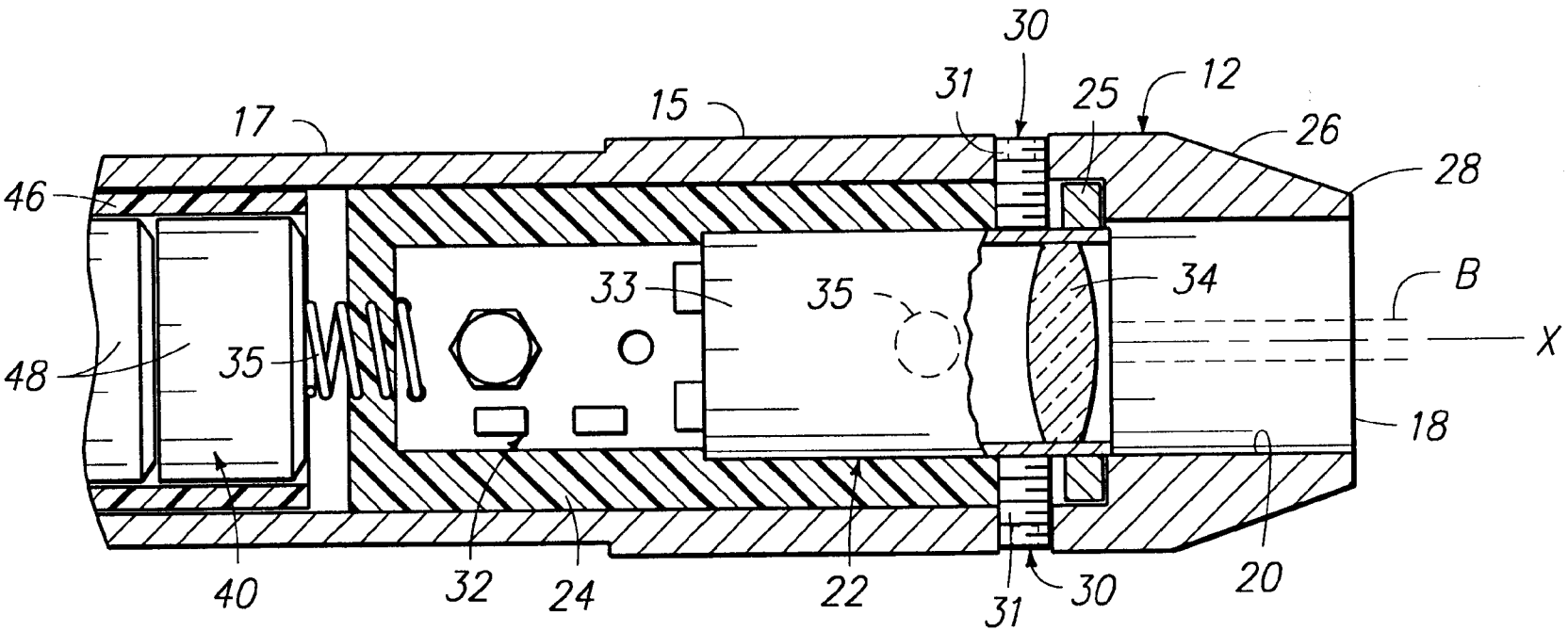
FIG. 4 is an enlarged fragmented sectional view illustrating potting material placement and related components.
Figure 11:
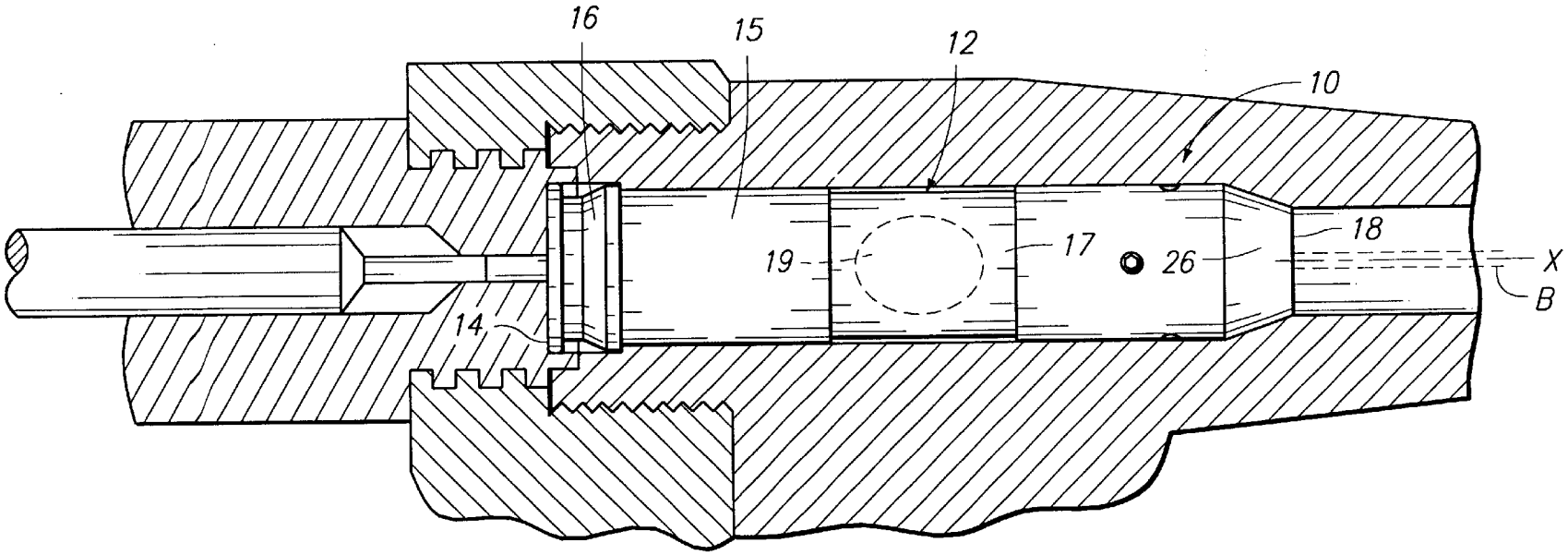

The switch 38 may be comprised of a switch housing 60 that may be threadably or otherwise releasably secured within the cartridge body 12 at the base end 16. The switch housing 60 includes a plunger 61 with an outwardly projecting end that is provided to be somewhat larger in diameter than a typical firearm firing pin. Thus, the plunger end may be engaged by the bolt face or hammer of the associated firearm and moved axially by the bolt face (not the firing pin) to a "on" position. In preferred forms, the plunger includes a recess 65 (FIG. 3) that is shaped to loosely receive the firing pin should the firing pin be accidently released.

The plunger is yieldably retained in the rearwardly projecting position by a first compression spring 62. This spring 62 may be held by a retaining ring 63 that may be press fitted or otherwise secured within the plunger bore. A second contact spring defines the electrical contact 64, which may be engaged with the plunger 61 for selective contact with the battery 48 that is held in proximity to the switch by provision of the battery holder flange 50. Thus, the battery or batteries 48 (four being shown in the illustrated example) are continually engaged in at one end (of the battery stack) by the battery contact 42. The opposite end of the battery stack may be periodically contacted by the contact 64 upon depression of the plunger 61.

The plunger 61 and switch housing 60 will permit an electrical circuit to provide power to the beam-emitting device 22, thereby switching the unit to the "on" position. The "on" position may be a position corresponding to the locking of a rifle bolt or the closure of a hammer against the plunger 61, causing the plunger 61 to move forwardly and to shift the spring contact 64 into engagement with the batteries 48. Should accidental discharge or actuation of the firearm trigger cause the related firing pin to move to engage the plunger, the recess 65 will loosely receive the firing pin, and even if contact is made, free play or compression capability of the contact 42 and spring 63 may absorb the impact energy of the firing pin and prevent damage from being done to the remainder of the sighting components.

Prior to use, the unit may be most advantageously precalibrated during manufacture so that the ultimate user will not have a need to make particular adjustments. The user simply is required to install batteries periodically and this may be easily accomplished by simply removing the switch 38 and sliding the battery holder 46 outwardly. The encased battery or batteries can then be easily removed and replaced. The switch 38 can then be repositioned and the unit is ready for use.

For operation, the cartridge body 12 is placed in the firing chamber of a firearm and the bolt or hammer is closed to depress the plunger 61. This completes a circuit for electrical energy to be delivered to the optical beam-emitting device 22.

The resulting beam B will be coaxial with the central axis X of the cartridge body. The cartridge body 12, in turn, by reason of the coaxial nature of the firing chamber, will be coaxial with the bore of the firearm barrel (FIG. 5). Thus, the beam emitting from the firearm will be coaxial with the barrel bore and the dot of light can be projected forwardly of the firearm to accurately reflect the position of the bore axis at substantial distances from the firearm.

A target placed at, say, thirty yards from the firearm, may be used as a reference point. The light beam B may be directed onto the target and the dot of light will indicate a location that is coaxial with the bore axis of the firearm barrel. The dot indicates and simulates the anticipated impact point from a bullet discharged through the barrel. The sighting devices (telescopic, "iron", optic sights or the like) associated with the firearm may then be adjusted to conform or identify that point. The firearm is now properly "sighted in" for that particular distance.

The user may carry the sighting system and be able to accurately adjust the sights of a weapon at any convenient time or place without requiring discharge of the weapon. This may be a significant advantage to many hunters or others who are in situations where they would like to reassure themselves of an accurate weapon but do not have the opportunity to discharge the weapon to determine the sighting accuracy.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. In a firearm bore sighting system:

a cartridge body formed in the shape of a conventional firearm cartridge, and including a rim at a base end and a shoulder defining an open forward end;

wherein the body is formed along a central longitudinal cartridge axis and the shoulder is formed as a frustum of a cone, centered on the cartridge axis with the open forward end at a reduced end of the frustum a bore formed within the cartridge body along the cartridge axis;

an optical beam emitting device received within the bore and operable to generate an optical beam coaxially with the cartridge axis, and wherein the body includes an outward surface formed about the cartridge axis, and a reduced label surface spaced radially inward of the outward surface and situated between the forward end and base end, adapted to receive a warning label without said label projecting radially beyond the outward surface.

2. A bore sighting system, comprising:

a cartridge body formed in the shape of a conventional firearm cartridge, and including a base end and an open forward end;

a bore formed within the cartridge body along a cartridge axis;

an optical beam emitting device received within the bore, including an optical beam generating module having a battery contact;

a switch mounted to the cartridge body with an electrical contact thereon movable between an on and an off position;

a battery holder slidably received within the bore and configured to receive and orient at least one batter within the bore between the electrical contact of the switch and the battery contact; and wherein the battery holder includes an integral electrically insulating flange oriented to electrically isolate the battery and electrical contact in the off position, and to permit contact between the electrical contact and the battery with the electrical contact in the on position.

3. The firearm bore sighting system of claim 2 wherein the optical beam generating module is partially incased within potting material received within the bore, and wherein the battery contact is also partially encased within the potting material.

4. The firearm bore sighting system of claim 2 wherein the optical beam generating module is partially incased within potting material received within the bore, and wherein the potting material is a hardened resin.

5. A bore sighting system, comprising:

a cartridge body formed in the shape of a conventional firearm cartridge, and including a base end an a shoulder adjacent an open forward end;

a bore formed within the cartridge body along a cartridge axis;

wherein the body is formed along the cartridge axis and the shoulder is formed as a frustum of a cone, centered on the cartridge axis with the open forward end at a reduced en of the frustum;

an optical beam emitting device received within the bore, including an optical beam generating module having a battery contact;

potting material formed about the optical beam generating module within the bore, securing the beam emitting device in a spatial relation to the cartridge axis such that an optical beam emitted from the beam emitting device is coaxial with the cartridge axis;

beam calibrating adjustments mounted between the beam emitting device and the cartridge body, said adjustments being axially staggered with respect to the bore axis and spaced an angularly about the bore axis;

a switch mounted to the cartridge body with an electrical contact thereon movable between an on and an off position;

a battery holder slidably received within the bore and configured to receive and orient at least one battery within the bore between the electrical contact of the switch and the battery contact; and wherein the battery holder includes an integral electrically insulating flange oriented to electrically isolate the battery and electrical contact in the off position, and to permit contact between the electrical contact and the battery with the electrical contact in the on position.

* * * * *

UNITED STATES PATENT AND TRADEMARK OFFICE

CERTIFICATE OF CORRECTION

PATENT NO. : 6,631,580 B2
DATED : October 14, 2003
INVENTOR(S) : Iafrate et al.

It is certified that error appears in the above-identified patent and that said Letters Patent is hereby corrected as shown below:

Column 3,
Line 28, replace "20, and potting material 24 us formed about the beam"
with -- 20, and potting material 24 is formed about the beam --

Column 9,
Line 47, replace "configured to receive and orient at least one batter"
with -- configured to receive and orient at least one battery --

Column 10,
Line 24, replace "reduced en of the frustum;"
with -- reduced end of the frustum; --
Line 36, replace "axis and spaced an angularly about the bore axis;"
with -- axis and spaced angularly about the bore axis; --

Signed and Sealed this

Eighth Day of June, 2004

JON W. DUDAS
*Acting Director of the United States Patent and Trademark Office*